United States Patent [19]

Svatý

[11] 4,111,239

[45] Sep. 5, 1978

[54] APPARATUS FOR RELEASABLY SECURING A FLUID-OPERATED GRIPPER SHUTTLE IN A LAUNCH POSITION

[75] Inventor: Vladimir Svatý, Liberec, Czechoslovakia

[73] Assignee: Elitex, Koncern textilniho strojirenstvi, Liberec, Czechoslovakia

[21] Appl. No.: 731,830

[22] Filed: Oct. 12, 1976

[30] Foreign Application Priority Data

Oct. 10, 1975 [CS] Czechoslovakia ..... 6855-75

[51] Int. Cl.[2] ..... D03D 49/24

[52] U.S. Cl. ..... 139/438; 139/144

[58] Field of Search ..... 139/142, 144, 437, 438; 60/473, 474, 475

[56] References Cited

U.S. PATENT DOCUMENTS

| | | | |
|---|---|---|---|
| 3,429,344 | 2/1969 | Svatý et al. | 139/144 |
| 3,433,271 | 3/1969 | Svatý et al. | 139/144 |
| 3,722,552 | 3/1973 | Indra et al. | 139/144 |

FOREIGN PATENT DOCUMENTS

| | | | |
|---|---|---|---|
| 600,615 | 7/1934 | Fed. Rep. of Germany | 139/144 |

*Primary Examiner*—Henry S. Jaudon

[57] ABSTRACT

Facilities for temporarily holding a rear portion of a fluid-actuated piston rod coupled to a gripper shuttle in a weaving loom are described. Pressurized fluid is cyclically introduced into a chamber that communicates at its rear end with an elastomeric reservoir and at its front end with the rear portion of a cylinder in which the piston rod moves, with a rear collar on the piston rod projecting into the chamber when the piston is in its rearmost launch position. A pivotally mounted fork is mounted in the chamber for normally engaging and immobilizing the collar on the piston rod. Prior to the initiation of launch, the fork is moved via a lever and pitman assembly from such locking position to a forward release position in which the piston rod may be propelled forwardly by pressurized fluid accumulated in the elastomeric reservoir. When the rear end of the piston rod again engages the fork at the conclusion of the succeeding return stroke, the fork is moved rearwardly into its rear locking position to hold the piston rod collar against inadvertent release until the start of the next launch stroke of the gripper shuttle.

6 Claims, 3 Drawing Figures

APPARATUS FOR RELEASABLY SECURING A FLUID-OPERATED GRIPPER SHUTTLE IN A LAUNCH POSITION

BACKGROUND OF THE INVENTION

The invention relates to weft insertion apparatus for shuttle-type weaving looms, and more particularly to apparatus of this general kind having facilities for periodically actuating a piston rod coupled to a gripper shuttle with a pressurized fluid to initiate a launch stroke of the shuttle.

A particularly advantageous hydraulically-instrumented arrangement of this type has been proposed in the copending, coassigned application Ser. No. 718,793, filed Aug. 30, 1976 and entitled "TECHNIQUE FOR CONTROLLABLY RECIPROCATING THE WEFT INSERTION PORTION OF A SHUTTLE-TYPE WEAVING LOOM". In such arrangement, hydraulic fluid is cyclically transferred from a first main fluid reservoir to points at the rear and forward end, respectively, of the piston rod. A second elastomeric fluid reservoir is disposed behind a perforated rear wall of a cylinder that supports the piston rod during its movement for storing fluid transferred to the rear end of the piston in preparation for the next-occurring launch stroke. In order to initiate the launch stroke, fluid is first abruptly released from the front of the piston, and thereafter fluid is introduced into the elastomeric reservoir to propel the piston rod, and thereby the gripper shuttle, forwardly into its operated position. With this expedient, the forward stroke of the piston rod proceeds without resistance caused by hydraulic pressure in front of the piston rod.

To initiate the return stroke, fluid is re-introduced from the first reservoir to the front end of the piston, and during the return stroke the fluid in the elastomeric reservoir behind the piston rod is simultaneously withdrawn into the first reservoir so that the return stroke proceeds without having to overcome the resistance of hydraulic pressure at the rear of the piston.

The fluid pressure at the front end of the piston rod is thereafter maintained until after a re-charging of the elastomeric reservoir, thereby preventing inadvertent release of the piston rod prior to its designated time of actuation for the next launch stroke.

SUMMARY OF THE INVENTION

The facilities of the present invention represents an auxiliary mechanical securing device for positively and releasably maintaining the piston rod in its rear-most or launch position prior to the initiation of a launching stroke.

In an illustrative embodiment, the front end of a working chamber that is disposed in a suitable housing communicates at its front end with the rear end of a cylinder in which the piston rod is movably supported. A fork element is pivotally supported in the front end of the working chamber for engaging a collar on the rear end of the piston rod when such rod is in its rear-most position within the cylinder. The fork element is movable between a first position, in which the tines of the fork are essentially transverse to the axis of the cylinder, and a second position in which the tines are inclined forwardly toward the axis of movement of the piston rod.

An actuating lever is also pivotally supported in the working chamber, and is coupled to the fork element for moving such element from its first position to its second position upon a corresponding actuation of the lever from a normal first position thereof to an operated second position. In the first position of the lever, the coupling element between the lever and the fork element is arranged to immobilize the fork element in its transverse position, thereby preventing movement of the piston rod when the collar thereof is engaged within the tines of the fork element.

A short time before the start of the launch stroke, the lever is actuated from its first to its second position to incline the tines of the fork element forwardly, so that the then-captured piston rod is free to be propelled forwardly upon the establishment of a pressure differential between the working chamber and the portion of the cylinder forwardly of the piston rod.

Once such differential pressure is established, the now-released piston can be propelled forwardly into its operated position, whereby a return stroke thereof may be initiated, as specified in the above-mentioned copending application Ser. No. 718,793, by establishing a complementary pressure difference in the opposite direction.

As the piston nears the working chamber at the conclusion of such return stroke, the collar on the rear end of the piston engages the forwardly inclined tines of the fork element and urges such fork element, and thereby the associated actuating lever, back into their first position, thereby again capturing and immobilizing the piston rod until immediately prior to the initiation of the next-succeeding launching stroke.

BRIEF DESCRIPTION OF THE DRAWING

The invention is further set forth in the following detailed description taken in conjunction with the appended drawing, in which.

DETAILED DESCRIPTION

Figure 1:
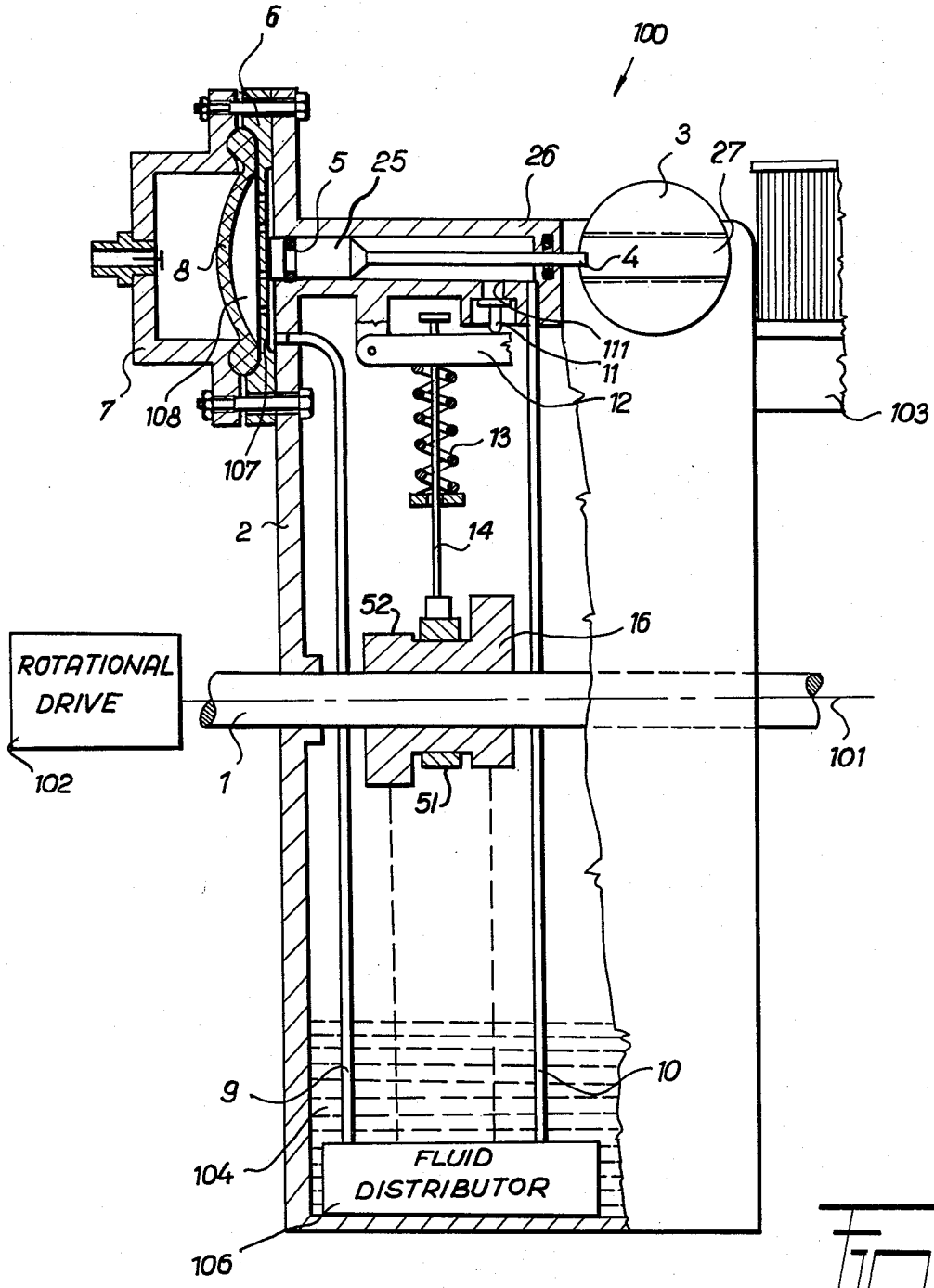
FIG. 1 is an elevation view, partially in section, of an arrangement for hydraulically reciprocating a shuttle-connected piston rod which may be temporarily secured in its rear-most position priorto launch with the arrangement of the present invention.

Referring now to the drawing, there is depicted a portion of a fluid-actuated weft insertion apparatus 100 in which the below-described releasable locking means of the invention can be advantageously employed. The insertion apparatus, which may be of the general type described, e.g., in the above-mentioned copending application Ser. No. 718,793, is adapted for use with a gripper shuttle-type weaving loom to effect the launch and return strokes of the shuttle.

In the depicted arrangement, the numeral 1 represents a rotatable underslay shaft which is supported for rotation about a central axis 101 and is rotatable in a first direction by means of a rotating drive 102.

The shaft 1 is provided with a plurality of cams (not shown) for controlling the motion of a conventional rotary gripper shuttle box 3 of the loom. A slay 103 is affixed to a substantially closed housing 2, which is pivotally supported on the shaft 1.

A hydraulic fluid reservoir 104 is disposed in the bottom of the housing 2. Fluid from the reservoir 104 is cyclically transferred, by a fluid distributor 106, to the front and rear, respectively, of a piston rod 4. The rod 4 is slidably supported in a cylinder 26 which is disposed and extends forwardly in the housing 2 above the reservoir 104. The front end of the rod 4 is extendable in a conventional manner into a groove 27 in the shuttle box 3 to control the launch and return strokes of the associated gripper shuttle (not shown) in synchronism with forward and rearward movements, respectively, of the rod 4 in the cylinder 26.

In the particular arrangement shown in FIG. 1, a piston 25 is secured to the rear end of the rod 4. The piston is provided intermediate its ends with a sealing ring 5 to prevent an undesired flow of fluid axially along the outer periphery of the piston.

The cylinder 26 is closed at its rear end by a perforated rear plate 6 having a concave central portion that defines an axial gap 107. At the conclusion of the return stroke of the rod 4, the rear end of the piston 25 extends through the gap 107 to abut the plate 6.

The plate 6 is bolted to a hermetically sealed, substantially U-shaped cover 7, which opens toward the plate 6. An elastic diaphragm 8 is clamped between the confronting ends of the cover 7 and the rear plate 6 to define an elastomeric rear boundary of a second reservoir 108, whose front boundary is defined by the plate 6 itself.

With such arrangement, fluid introduced into the reservoir 108 by the distributor 106 and applied to the rear end of the piston 25 through the gap 107 and the apertures in the rear plate 6 will be effective to urge the piston rod 4 in a forward direction to initiate a launch of the shuttle.

A radial opening 111 is provided in the front portion of the wall of the cylinder 26. The opening 111 is selectively blocked by means of a normally closed relief valve 11. The valve 11, in turn, is actuated by means of a lever 12, which may be pivoted against the force of a spring 13 upon a downward movement of a tie rod 14.

An integral, multi-part eccentric unit 16 is affixed to the shaft 1 within the housing 2 for timing the operations of the distributor 106 and has a portion 51 for engaging and operating the tie rod 14. The eccentric unit 16 is so constructed that upon a rotation of the shaft 1 through a suitable angle, fluid will be directed, by the distributor 106, from the main reservoir 104 to the elastomeric reservoir 108 via a conduit 9.

After a charge of fluid has been so-introduced into the reservoir 108, the tie rod 14 is moved downwardly by the eccentric unit 16 to actuate the lever 12 and thereby open the valve 11. Such valve opening will immediately relieve hydraulic pressure at the front portion of the piston 25, so that the fluid charge in the reservoir 108, bearing against the rear end of the piston 25, will permit the rod 4 to move forwardly abruptly and to thereby launch the gripper shuttle with a minimum of hydraulic resistance.

At the conclusion of each launch stroke with the rod 4 in its front-most position, the distributor 106 will cause fluid from the reservoir 104 to be introduced into the space of the cylinder 26 forwardly of the piston 25 via a conduit 10, so that the resulting pressure applied to the front portion of the piston 25 will initiate the return stroke of the piston 25 and the rod 4. During such return stroke, the distributor 106 will permit fluid in the reservoir 108 to be continually discharged through the conduit 9 and into the main reservoir 104 until the piston 25 and rod 4 have reached their rear-most position (again with a minimum resistance of hydraulic pressure), in preparation for the next launch stroke.

Figure 2:
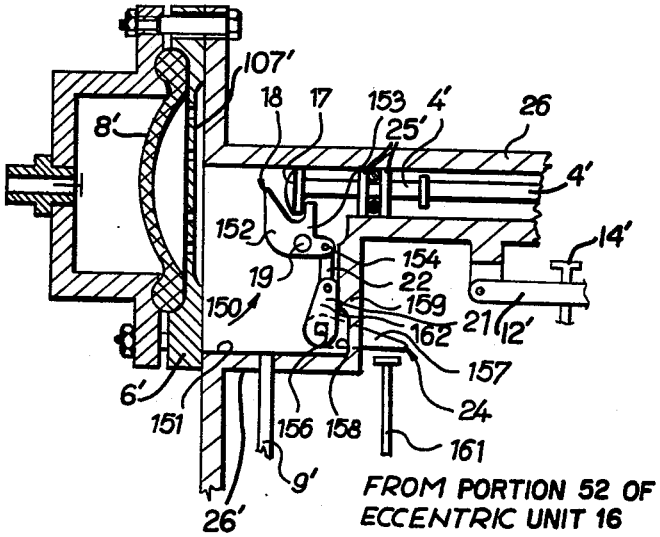
FIG. 2 is a fragmentary view of a portion of the arrangement of FIG. 1, illustrating a modification thereof for releasably securing the piston rod in its rear-most position in accordance with the invention, with the releasable securing means being shown in a first immobilizing position.
Figure 3:
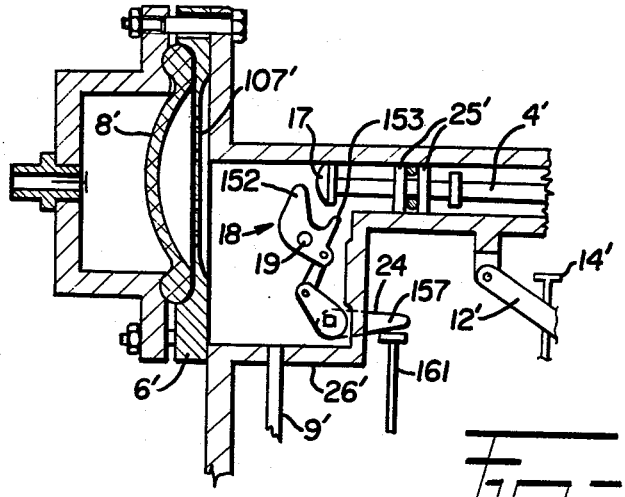
FIG. 3 is a fragmentary view similar to FIG. 2 but showing the releasable securing means in a second release position.

In accordance with the invention, the general arrangement of FIG. 1 may be modified as shown in FIGS. 2-3. In this embodiment those elements similar and/or equivalent in function to corresponding elements of the embodiment of FIG. 1 have been designated with the same reference number plus a prime, "'". To permit the piston rod 4' to be releasably secured in its rear-most position at the conclusion of each return stroke to prevent inadvertent forward movement of the rod prior to the desired moment of initiation of the next launch stroke a retention mechanism has been provided in the embodiment of FIG. 2. Such modification includes the incorporation of a positive-acting releasable locking arrangement indicated generally at 150.

The locking arrangement 150 includes a fork element 18 which is pivotally supported on a pin 19 that is positioned within a working chamber 151 that forms an enlarged rear region of the cylinder 26' as shown. In the rear-most position of the piston rod 4' illustrated in FIG. 2, a collar 17 secured to a pistion 25' extends rearwardly into the chamber 151, such collar 17 being for cooperation with the fork element 18 of the locking apparatus 150 now to be described.

The fork element 18 is provided with a pair of dissimilar tines 152, 153 for receiving therebetween the collar 17 mounted rearwardly relative to the piston 25'. The fork element 18 further includes a projection 154, which is connected by means of a pitman arm 22 to one end of a balance beam 21, which in turn is pivotally supported on a pin 156. The pin 156 is secured in the chamber 151 in parallel relation to the pin 19.

A single-armed lever 24 is also pivoted on the pin 156 and has an arm 157 extending outwardly through a slot 158 in a boundary wall 159 of the chamber 151.

The lever 24 is operable, from a first normal position shown in FIG. 2, to a second operated position shown in FIG. 3 by means of a tie rod 161 which, like the tie rod 14 of FIG. 1, can be suitably coupled to the eccentric unit 16 for cyclic actuation of the lever as the underslay shaft 1 rotates. For example the rod 16 may be operatively associated with portion 52 of eccentric unit 16. The lever arm 157 is normally immobilized in the position shown in FIG. 2 by the contact of the associated balance beam 21 with an interior surface 162 of the boundary wall 159.

As indicated, the fork element 18, pivoted about pin 19, and the balance beam 21 and lever 24, pivoted about the pin 156, are so coupled via the pitman arm 22 that when the lever arm 157 is in the normal position indicated in FIG. 2, the fork element 18 is disposed with the tines 152, 153 thereof substantially transverse to the longitudinal axis of movement of the piston rod 4'. In addition, the actuation of the lever arm 157 from the normal to the operated position will cause the tines 152, 153 to be moved into a position forwardly oblique to the piston rod axis as shown in FIG. 3.

In operation, it will be assumed that the piston rod 4' is in its rear-most position as shown in FIG. 2. In such position, the collar 17 is secured between the tines 152 and 153 of the fork element 18. Because of the immobilization of the fork element 18 in the position shown in FIG. 2 when the lever arm 157 is in its unoperated position, any tendency of the rod 4' to move forwardly prior to the initiation of the launch stroke will cause the collar 17 to engage and be restrained by the immobilized tine 153.

Because of such restraint, the application of pressurizing fluid to the working chamber 151 via the conduit 9' to effect a pressure differential between the chamber 151 and the non-illustrated front end of the piston 25' will be initially insufficient by itself to release the piston rod 4'.

However, upon a subsequent upward movement of the tie rod 161 at the instant when the launch stroke is to be initiated, the lever arm 157 will be moved into its operated position, thereby pivoting the fork element 18 into the forward oblique position shown in FIG. 3 to effect a release of the collar 17. Consequently, the pressure differential established in the forward direction along the cylinder 26 can now effect a forward movement of the released piston rod 4' to launch the shuttle.

At the conclusion of the following return movement of the piston rod 4', the collar 17 will be urged rearwardly against the now-oblique fork element 18, and will pivot such element 18 about the pin 19 until the locking position illustrated in FIG. 2 is again obtained. Once in such position, the rod 4' will be restrained from forward movement by the fork element 18 in the manner described above until the positive initiation of the next launch stroke.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a fluid-actuated weft insertion apparatus for a weaving loom that includes a reciprocable shuttle, the apparatus comprising, in combination, a housing, a cylinder disposed and extending forwardly in the housing, a working chamber disposed in the housing, and having a front end communicating with a rear end of the cylinder, a piston rod supported for reciprocation in the cylinder and coupled to the shuttle for launching the shuttle when the piston rod is moved forwardly in the cylinder from a rear-most position thereof, a piston secured to the rear portion of the piston rod, a collar secured to and extending rearwardly from the piston, releasable locking means supported in the working chamber ad engageable with the collar for movement between a first rear position for immobilizing the then-engaged collar and a second front position for releasing the collar so that the piston rod may thereafter be propelled in a forward direction when a fluid pressure differential is established between the working chamber and in the cylinder forwardly of the front end of the piston, first mechanical means disposed in the housing for cyclically operating the locking means from its first to its second position while the collar remains immobilized, and second means operable in timed relation to the first operating means for establishing said fluid pressure differential to initiate a launch of the shuttle.

2. Apparatus as defined in claim 1, in which the second operating means comprises means for introducing pressurized fluid into the working chamber.

3. Apparatus as defined in claim 1, in which the apparatus further comprises a collar secured to the rear end of the piston rod.

4. In a fluid-actuated weft insertion apparatus for a weaving loom that includes a reciprocable shuttle, the apparatus comprising, in combination, a housing, a cylinder disposed and extending forwardly in the housing, a working chamber disposed in the housing and having a front end communicating with a rear end of the cylinder, a piston rod supported for reciprocation in the cylinder and coupled to the shuttle for launching the shuttle when the piston rod is moved forwardly in the cylinder from a rear-most position thereof, releasable locking means supported in the working chamber and engageable with the rear end of the piston rod for movement between a first rear position for immobilizing the then-engaged rear end of the piston rod and a second front position for releasing the engaged piston rod so that the piston rod may thereafter be propelled in a forward direction when a fluid pressure differential is established between the working chamber and the portion of the cylinder forwardly of the front end of the piston, first means disposed in the housing for cyclically operating the locking means from its first to its second position, and second means operable in timed relation to the first operating means for establishing said fluid pressure differential to initiate a launch of the shuttle, in which the locking means comprises fork means having a pair of spaced tines and means for pivotally supporting the fork means for movement in the working chamber between a first position in which the tines are substantially transverse to the axis of the cylinder and a second position in which the tines are inclined forwardly toward the axis of the cylinder in the path of movement of the piston rod, the first and second positions of the fork means respectively defining the first and second positions of the locking means; and in which the first means comprises means for actuating the fork means from its first to its second position.

5. Apparatus as defined in claim 4, in which the first means comprises, in combination, a lever pivotally supported in the working chamber for movement between a first position and an operated second position, means for coupling the lever to the fork means for moving the fork means from its first to its second positions when the lever is operated from its first to its second positions, and means disposed in the housing for cyclically operating the lever from its first to its second position.

6. Apparatus as defined in claim 5, in which the apparatus further comprises means for normally securing the lever in its first position to effect a corresponding immobilizing of the fork means in its corresponding first position.

* * * * *